US007002119B2

(12) United States Patent
Wu

(10) Patent No.: US 7,002,119 B2
(45) Date of Patent: Feb. 21, 2006

(54) DEVICE FOR LIQUID HEATING BY ELECTROMAGNETIC INDUCTION AND SHORT-CIRCUIT USING THREE-PHASE INDUSTRIAL FREQUENCY POWER

(76) Inventor: Ronghua Wu, Changzhou Sanli Electronics Co., No. 8, Guangcheng Road, Changzhou city, Jiangsu Province 213015 (CN)

( * ) Notice: Subject to any disclaimer, the term of this patent is extended or adjusted under 35 U.S.C. 154(b) by 0 days.

(21) Appl. No.: 10/495,932

(22) PCT Filed: Oct. 22, 2002

(86) PCT No.: PCT/CN02/00739

§ 371 (c)(1),
(2), (4) Date: May 18, 2004

(87) PCT Pub. No.: WO03/045113

PCT Pub. Date: May 30, 2003

(65) Prior Publication Data

US 2005/0011884 A1 Jan. 20, 2005

(30) Foreign Application Priority Data

Nov. 18, 2001 (CN) ..... 01134187 A

(51) Int. Cl.
*H05B 6/10* (2006.01)

(52) U.S. Cl. ..... 219/630; 219/670; 219/669

(58) Field of Classification Search ..... 219/628–631, 219/670, 669, 672, 660
See application file for complete search history.

(56) References Cited

U.S. PATENT DOCUMENTS

| | | | | |
|---|---|---|---|---|
| 3,388,230 A | * | 6/1968 | Cunningham et al. | 219/630 |
| 3,414,698 A | * | 12/1968 | Bedford et al. | 219/630 |
| 4,602,140 A | | 7/1986 | Sobolewski | 219/630 |
| 5,006,683 A | * | 4/1991 | Rapin et al. | 219/630 |

FOREIGN PATENT DOCUMENTS

| | | |
|---|---|---|
| CN | 1180984 A | 5/1998 |
| EP | 0383272 | 8/1990 |
| EP | 0516881 | 12/1992 |

* cited by examiner

*Primary Examiner*—Philip H. Leung
(74) *Attorney, Agent, or Firm*—Duane Morris LLP

(57) ABSTRACT

The present invention relates to the field of electromagnetic induction and short circuit heating. The iron core in the heating device of present invention, which is in the form of EI, is completely made of multi-layered silicon steel sheets to form a closed three-phase magnetic loop; each of the three core legs of the EI-formed iron core is coiled with a winding, i.e. the three-phase primary winding; the iron core and the three-phase primary windings are all enclosed in a metal shell, which is the secondary side that surrounds the iron core and the primary winding of each phase along the closed three-phase magnetic loop to constitute the main heating body of this heating device, in addition to act as a protecting shell and a radiator for the iron core and the three-phase primary winding. During operation, high current is induced in each secondary metal ring of the metal shell; the secondary metal ring of each phase is conductively connected through the same metal shell so that high currents are generated from interphase and three-phase short-circuits; the two high currents heat the metal shell rapidly; and the metal shell is at zero potential for safety and reliability as well.

4 Claims, 4 Drawing Sheets

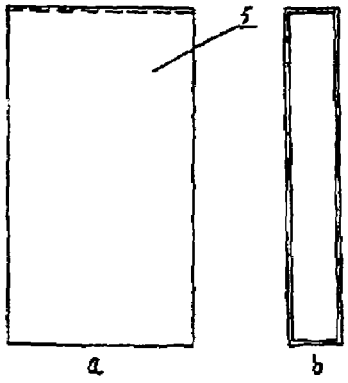
Figure 2-1
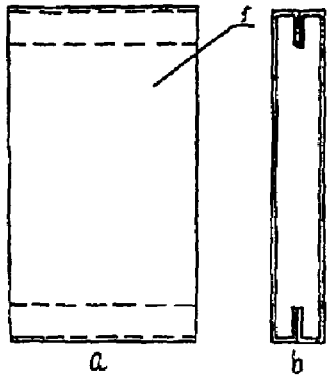
Figure 2-2
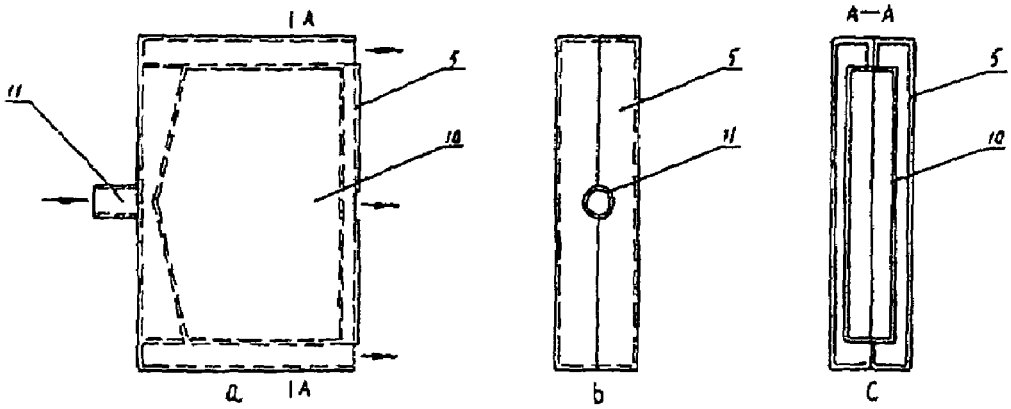
Figure 2-3
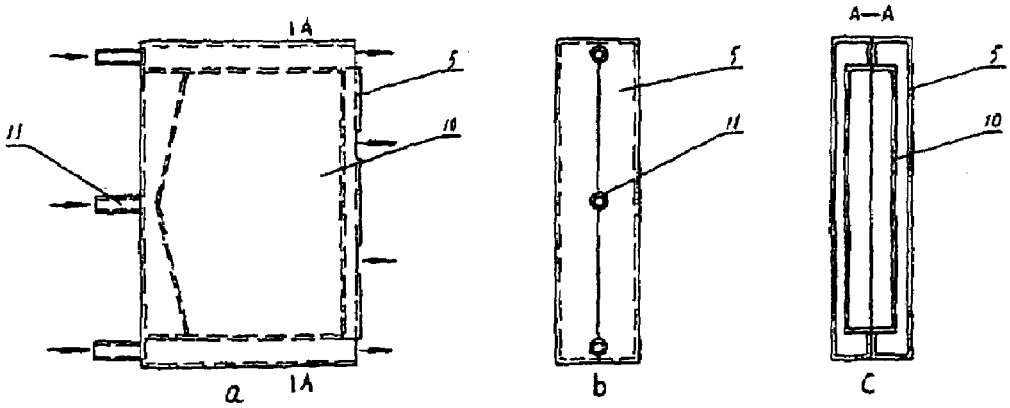
Figure 2-4
Figure 2

DEVICE FOR LIQUID HEATING BY ELECTROMAGNETIC INDUCTION AND SHORT-CIRCUIT USING THREE-PHASE INDUSTRIAL FREQUENCY POWER

TECHNICAL FIELD

The present invention relates to a device for heating by electromagnetic induction and short-circuit, or more exactly, a device for liquid heating by electromagnetic induction and short-circuit using three-phase industrial frequency power.

BACKGROUND TECHNOLOGY

The existing power frequency induction devices for liquid heating can be divided into two types, i.e. current heating and eddy-current heating, by their working principle of heating, as is referred to in European Patent EP0383272A2 and Chinese Patent ZL97106984.4.

The working principle described in European Patent EP0383272A2 is: when the primary winding is connected with an industrial frequency power source, a low voltage-high current is induced in the metal pipes as the secondary side so that the metal pipes are heated and the heat is conducted to the liquid. Its structure is: the iron cores are all laminated by silicon steel sheets, which surround the primary winding and the metal pipes as the secondary side one by one from inside out on the core legs of the iron core to form an integral part that goes through the liquid container. A resinous mold is filled out between the primary and secondary sides so that the vacancy that is unfavorable for heat conduction is eliminated and uniform heat generation from the surfaces of the secondary metal pipes is made possible. It is obvious in this structure that the core legs of the iron core are put through the container together with the secondary metal pipes to form a closed magnetic loop with the upper and lower yokes outside the container. Thus, in terms of the relations between power and safety voltage, a lower power will lead to a lower voltage on the secondary metal pipes and a higher power will result in a higher voltage on the secondary metal pipes to affect safety, that is to say, this heating method is limited by power. This is further evidenced by the following formulas: (1) $S=K\sqrt{P}$, in which the cross-section S of the iron core is directly proportional to the square root of power P, and K is a constant; (2) $S=E/4.44fBN$, in which the electromotive force E (that may be seen as the supply voltage here), the frequency $f$ and the magnetic induction intensity B are considered as certain values so that the cross-section S of the iron core is inversely proportional to the number of turns N; the higher the power, the higher will be the voltage on each turn. In addition, a number of problems, such as oversize, low power, low thermal efficiency and complicated manufacturing process, may also exist with the heating device that its container is integrated in it and the iron core at the yoke area is placed outside the container and exposed to the atmosphere. As for the problems with other existing heating methods, details are given in this patent description.

The working principle for liquid heating described in Chinese Patent ZL97106984.4 is: the iron core is laminated by silicon steel sheets in the shape of "m" and the ferromagnetic steel part, i.e. the steel magnet, is positioned on the upper part of the iron core in the shape of "m". The three-phase magnetic conductor made of above two different materials creates a closed three-phase magnetic loop, which connects the windings on the three legs of the iron core in the shape of "m" to a three-phase industrial frequency power source. Therefore, a three-phase alternating magnetic flux that is far stronger than the eddy-current and magnetic hysteresis of the iron core is generated in the steel magnet, which is in turn heated rapidly. Here, the major source of heat comes from the eddy-current so that it is briefly called eddy-current heating. Its structure is: the upper end of the metal shell is welded to the lower end of the above steel magnet in an enclosed mode so that the above-mentioned iron core and windings are encapsulated in this metal shell. The leading wires of the windings are led out from a connector base that is positioned on one side of the metal shell. All vacancies in the metal shell as well as in the connector base are packed with insulating fillers so as to form a completely enclosed solid body. When it is used, all its parts but the opening of outgoing lines are immersed in liquid. During operation, the heat generated by the steel magnet, iron core and windings is conducted to the surrounding liquid through the metal shell directly or indirectly. It is obvious here that the heat radiation from the metal shell to the areas surrounding the winding of each phase is uneven, so that winding temperature may rise higher at local areas of the windings between two phases UV and two phases VW to affect the service life. In addition, this device has other inadequacies in its oversized section of iron core and low power factor.

SUMMARY OF THE INVENTION

An object of the present invention is to provide a device for heating by electromagnetic induction and short-circuit using Three-phase industrial frequency power, which features significant increase of output power and power factor, considerable reduction of manufacturing cost as well as safety and reliability in operation.

The general technical conception of the present invention is: by applying the principle of heating with high currents from electromagnetic induction and short-circuit, a metal shell can be made as the secondary side that surrounds the iron core and the primary winding of each phase along the closed three-phase magnetic loop to constitute the main heating body of this heating device, in addition to act as a protecting shell and a radiator for the iron core and the three-phase primary windings.

The above object of the present invention for a device of liquid heating by electromagnetic induction and short-circuit using three-phase industrial frequency power, is achieved through a technical scheme: the heating device comprising an EI-formed core that is completely made of multi-layered silicon steel sheets to form a closed three-phase magnetic loop, wherein each of the three core legs of the EI-formed iron core is coiled with a primary winding, i.e. the three-phase primary winding, which is set up from left to right in three phase sequence as indicated separately by U, V, W and can be connected by star (Y) or delta (Δ) connection; the iron core and the three-phase primary windings being all enclosed in a metal shell, in which the space are packed with insulating fillers to form a completely-enclosed solid body, is structurally characterized in that: the metal shell is set along the closed three-phase magnetic loop to form the secondary side of each phase that surrounds the iron core and the primary winding of each phase so as to constitute the main heating body of this heating device, in addition to act as a protecting shell and a radiator for the iron core and the three-phase primary windings; as the secondary side of each phase is conductively connected through the same metal shell to create interphase short-circuit and three-phase short-circuit in the secondary side, the vector sum of the three-phase short-circuit comes to zero and the metal shell is at zero potential during operation.

Said metal shell is provided with top fray and bottom tray, a shell case, two rectangular tubes and a connector base; the connector base is welded under one side of the shell ease with the leading wires of the three-phase primary windings led from the connector base; the top tray and bottom fray are welded to the top and bottom ends of the shell case respectively, of the two rectangular tubes, the first rectangular tube is positioned between two phrases of the Three-phase primary windings and between the upper and lower yokes of the corresponding iron core while the second rectangular tube is positioned between two phases VW of the three-phase primary windings and between the upper and lower yokes of the corresponding iron core; the two rectangular tubes go through the front and rear sides of the shell case while the four sides of their front and rear ends are respectively welded to the front and rear surfaces of the shell case; thus the left and right sides of the two rectangular tubes together with the shell case create separately three metal rings as secondary sides, as indicated again by U, V, W in phase sequence, to surround the primary winding of each phase, while the upper sides of the two rectangular tubes together with the shell case and the top tray create separately two metal rings as secondary sides to surround the upper yoke and the lower sides of the two rectangular tubes together with the shell case and the bottom tray create separately two metal rings as secondary sides to surround the lower yoke; the above metal rings acting as secondary sides make full use of the effective length of the three-phase magnetic loop of iron core so that the output power of the whole unit is increased.

The front and rear ends of the said rectangular tubes assume opened status and the upper and lower surfaces of the rectangular tubes in opened status can be provided with introflexed wings.

The said rectangular tubes may be semi-enclosed at the front and rear ends, with at least one liquid inlet on one end and at least three liquid outlets on the other end; the rectangular tubes are provided in their inner cavities with flow deflectors that have the functions of heat radiation and flow speed acceleration.

The top and bottom trays, the shell case, two rectangular tubes and the flow deflectors that compose the said metal shell can be manufactured with metal sheets in 1–3 mm thickness. The metal sheets can be stainless steel, steel or aluminum sheets. For the connector base, profiled stainless steel tube can be used.

The metal shell of the heating device is set along the closed three-phase magnetic loop to form the secondary side of each phase that surrounds the iron core and the primary winding of each phase so as to constitute the main heating body of this heating device, in addition to act as a protecting shell and a radiator for the iron core and the three-phase primary windings; all parts of the said heating device but the opening of outgoing lines are immersed in liquid when the tree-phase primary windings of this fluid heating device are connected with a three-phase industrial frequency power source, high current is induced in each secondary metal ring of the metal shell that surrounds the iron core and the primary winding of each phase along the closed three-phase magnetic loop; the secondary metal ring of each phase is conductively connected trough the same metal shell so that high currents are generated from interphase and three-phase short-circuits; under the combined effects of the two high currents, the metal shell is heated rapidly and the generated heat is in turn conducted to the liquid surrounding the metal shell; the vector sum of the three-phase short-circuit created by the secondary metal rings comes to zero so that the metal shell is at zero potential. This heating method with double high currents increases the output power of the whole unit effectively.

The working principle of the present invention is: the induced current in the said secondary metal rings corresponds in principle to the equation $I_1N_1=I_2N_2$, in which $I_1$ stands for primary current, $I_2$ for secondary current, $N_1$ for number of turns on primary side, $N_2$ for number of turns on secondary side and $N_2$ here is 1 turn. In addition, each short-circuit current $I_{DL}$ generated by interphase and three-phase short-circuits in each secondary metal ring is directly proportional to its own short-circuit electromotive force E and inversely proportional to its own short-circuit impedance Z, which can be expressed by the simple formula $I_{DL}=E/Z$.

BRIEF DESCRIPTION OF THE DRAWINGS

FIG. 2 is a schematic view of the rectangular tube structures in the device of heating by electromagnetic induction and short-circuit using three-phase industrial frequency power according to the present invention, in which:

FIG. 2-1 shows a rectangular tube in opened status, in which FIG. 2-1*a* is a front view and FIG. 2-1*b* is a lateral view of FIG. 2-1*a;*

FIG. 2-2 shows a rectangular tube, which is provided with introflexed wings, in opened status, in which FIG. 2-2*a* is a front view and FIG. 2-2*b* is a lateral view of FIG. 2-2*a;*

FIG. 2-3 shows a type of semi-enclosed rectangular tube, in which FIG. 2-3*a* is a front view, FIG. 2-3*b* is a lateral view of FIG. 2-3*a* and FIG. 2-3*c* is a lateral section view of FIG. 2-3*a;*

FIG. 2-4 shows another type of semi-enclosed rectangular tube, in which FIG. 2-4*a* is a front view, FIG. 2-4*b* is a lateral view of FIG. 2-4*a* and FIG. 2-4*c* is a lateral section view of FIG. 2-4*a*.

FIG. 3 is a schematic view of a structure of the device of heating by electromagnetic induction and short-circuit using three-phase industrial frequency power according to the present invention, in which FIG. 3-*a* is a front view, FIG. 3-*b* is a lateral view of A-A section of FIG. 3-*a* and FIG. 3-*c* is a lateral view of B-B section of FIG. 3-*a*.

FIG. 4 is a schematic view of another structure of the device of heating by electromagnetic induction and short-circuit using three-phase industrial frequency power according to the present invention, in which FIG. 4-*a* is a front view and FIG. 4-*b* is a lateral view of A-A section of FIG. 4-*a*.

In the attached drawings explained above: 1—iron core, 2—primary winding, 3*a*—top tray, 3*b*—bottom tray, 4—shell case, 5—rectangular tube, 5*a*—first rectangular tube, 5*b*—second rectangular tube, 6—connector base, 7—insulating plate, 8—leading wire, 9—insulating filler, 10—flow deflector, 11—inlet round tube, 12—outlet, 13—circulation container, 14—base frame, 15—round hole, 16—inlet header pipe, 17—branch pipe, 20—heating device, 30—heating device, 40—circulation-heating device

DETAILED DESCRIPTION OF PREFERRED EMBODIMENTS

Example Embodiment 1

Figure 1:
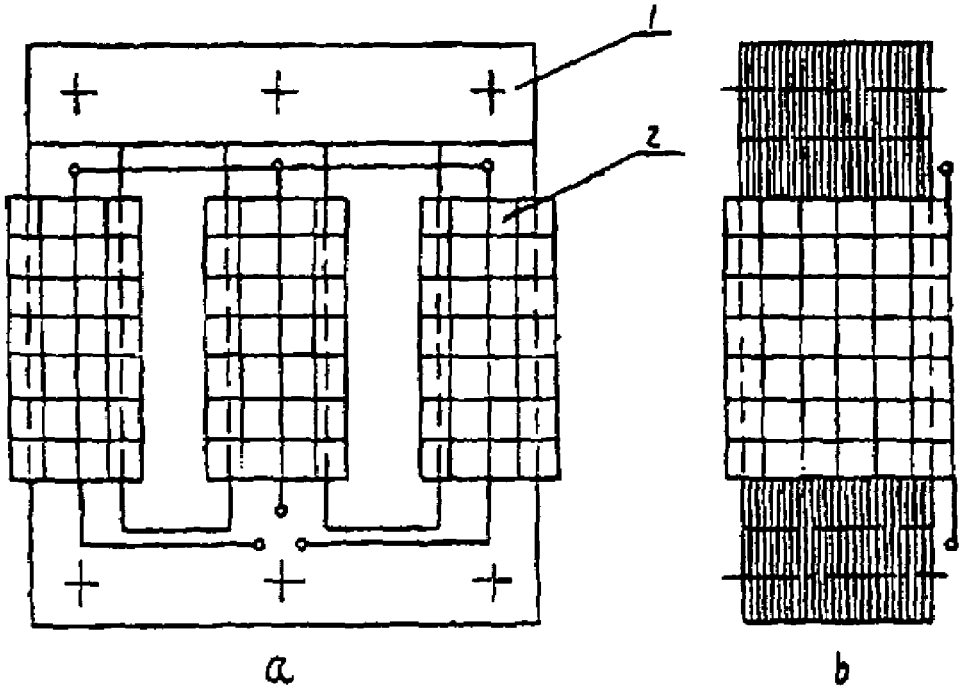
FIG. 1 is a schematic view of the structure of iron core and windings in the device of heating by electromagnetic induction and short-circuit using three-phase industrial frequency power according to the present invention, in which FIG. 1-*a* is a front view and FIG. 1-*b* is a lateral view of FIG. 1-*a*.

The front and lateral views in FIG. 1 show the interrelated structures of iron core 1 and winding 2 according to the present invention. The iron core 1 in the form of EI is completely made of multi-layered silicon steel sheets to form a closed three-phase magnetic loop. Each of the three core legs of the EI-formed iron core 1 is coiled with a primary winding 2, i.e. the three-phase primary winding, which is set up from left to right in three phase sequence as indicated separately by U, V, W and can be connected by star (Y) or delta (Δ) connection; the drawing shows the delta (Δ) connection.

FIG. 2 shows four structures of rectangular tube 5 according to the present invention, in which:

FIG. 2-1 shows a rectangular tube 5 that its both ends are built with an opened structure.

FIG. 2-2 shows a rectangular tube 5 that its both ends are built with an opened structure and its upper and lower surfaces are provided with introflexed wings.

Figure 3:
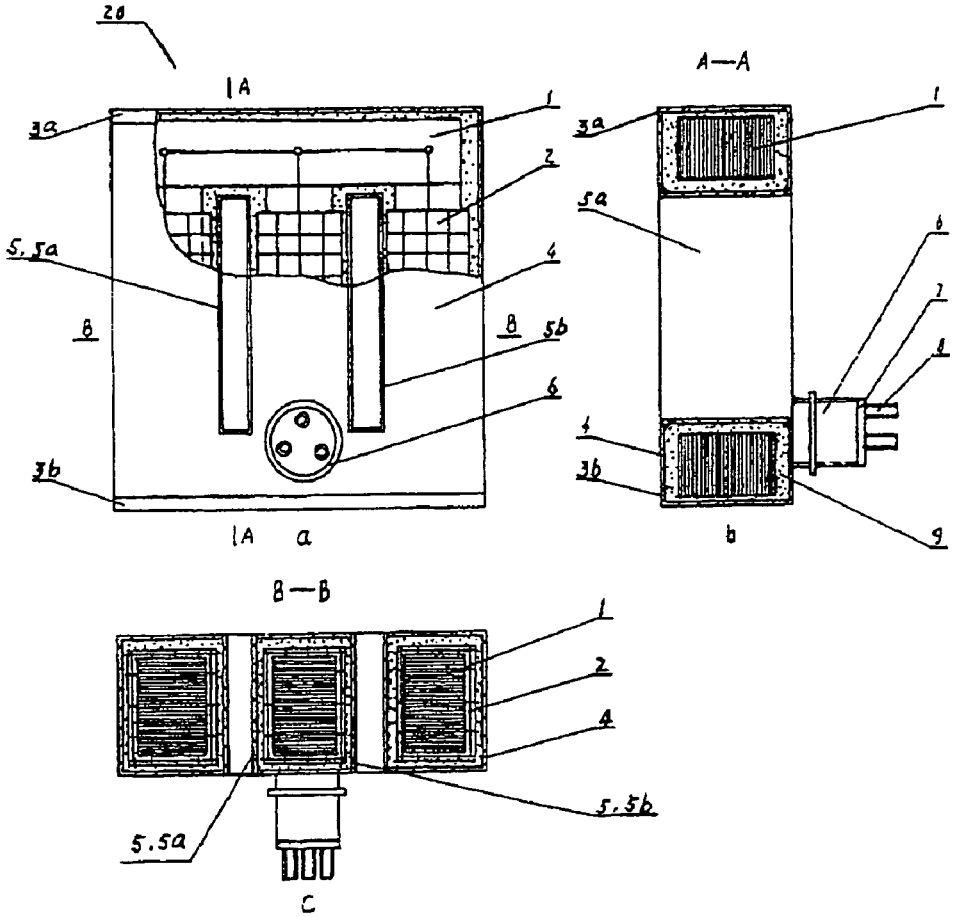

FIG. 2-3 shows a rectangular tube 5 that its both ends are built with a semi-enclosed structure. A round tube 11 is provided on one end of the rectangular tube 5 as its inlet and three square openings are provided on the other end as its outlet; a flow deflector 10 is provided in the inner cavity of the rectangular tube 5; the flow deflector 10 is a completely enclosed hollow tube, which upper and lower surfaces are welded to the upper and lower introflexed wings of the rectangular tube 5 and a certain distance is left between the periphery around the flow deflector 10 and the periphery near the inner walls of the rectangular tube 5; therefore, the flow deflector 10 can not only radiate heat for the rectangular tube 5 but also accelerate the flow speed of the liquid that flows through the rectangular tube 5; the flow deflector 10 can be manufactured with stainless steel sheet and the inlet round tube 11 can be manufactured with profile stainless steel tube.

Figure 4:
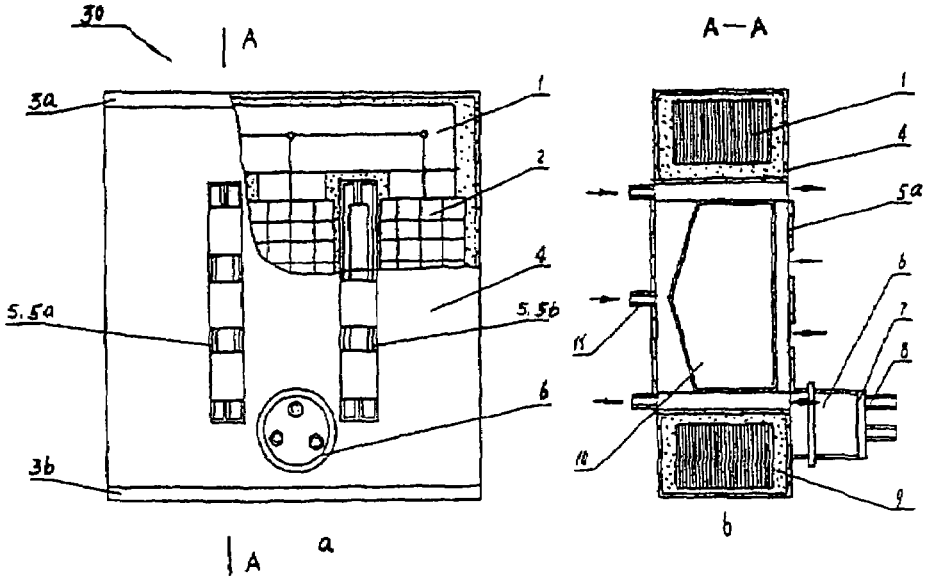

FIG. 2-4 shows another rectangular tube 5 that its both ends are built with a semi-enclosed structure, which is provided with 3 round tubes 11 on one end as its inlet and 4 square openings on the other end as its outlet. With the exception of this, the rest structures are identical to what are described above by referring to FIG. 2-3.

In FIG. 2, the rectangular tube in opened status is used in heating devices of smaller power according to the present invention. When a heating device of this type is in operation, the heat transfer in the liquid medium is conducted by natural convection. The semi-enclosed rectangular tube can be used in heating devices according to the present invention that have greater power ratings, wherein the heat transfer in the liquid medium is conducted by forced circulation. The structure of the rectangular tube 5 according to the present invention is not limited by the four types shown in FIG. 2. It may be varied by general technical personnel in this field based on their scope of knowledge.

The three views contained in FIG. 3 show a device 20 of fluid heating by electromagnetic induction and short-circuit using three-phase industrial frequency power according to the present invention. This heating device 20 encapsulates the iron core 1 and three-phase primary windings mentioned above in FIG. 1 all together into a metal shell case that consists of top tray 3*a* and bottom tray 3*b*, shell case 4, rectangular tubes 5 and connector base 6; the two rectangular tubes 5 consist of the first rectangular tube 5*a* and the second rectangular tub 5*b*; the leading wires 8 of the three-phase primary windings are led from the connector base 6 through the insulating plate 7; a certain insulating space is left in between the said metal shell and the iron core 1 as well as the three-phase primary windings. All vacancies in the metal shell are packed with insulating fillers 9 to form a completely enclosed solid body.

Referring to FIG. 3 again, with the exception of connector base 6 that is made of profiled stainless steel tube, all the rest parts composing the metal shell in this embodiment are assembled with components of stainless steel sheet that are punched and folded to the designed shape; the connector base 6 is welded under one side of the shell case 4; the top tray 3*a* is welded to the top end of the shell case 4 and the bottom tray 3 is welded to the bottom end of the shell case 4; the opened rectangular tubes 5 with the structure shown in FIG. 2-1 are used in heating device 20; the first rectangular tube 5*a* is positioned between two phases UV of the three-phase primary windings and between the upper and lower yokes of the corresponding iron core 1, while the second rectangular tube 5*b* is positioned between two phases VW of the three-phase primary windings and between the upper and lower yokes of the corresponding iron core 1; the two rectangular tubes 5 go through the front and rear sides of the shell case 4, while the four sides of their front and rear ends are respectively welded to the front and rear surfaces of the shell case 4; thus the left and right sides of the first rectangular tube 5*a* and the second rectangular tube 5*b* together with the shell case 4 create separately three metal rings (referring to B-B section in FIG. 3-*c*) as secondary sides, as indicated again by U, V, W in phase sequence, to surround the primary winding 2 of each phase; the upper sides of the two rectangular tubes 5 together with the shell case 4 and the top tray 3*a* create separately two metal rings as secondary sides to surround the upper yoke, while the lower sides of the two rectangular tubes 5 together with the shell case 4 and the bottom tray 3-*b* create separately two metal rings as secondary sides to surround the lower yoke (referring to A-A section in FIG. 3-*b*, showing two secondary metal rings of phases UV). The above metal rings acting as secondary sides make full use of the effective length of the three-phase magnetic loop of iron core so that the output power of the whole unit is increased.

In FIG. 3 mentioned above, the left side of the first rectangular tube 5*a* acts as the metal ring of phase U and its right side acts as the metal ring of phase V; the secondary metal rings of these two different phases are conductively connected through the upper and lower sides of the rectangular tube 5*a* to create interphase short-circuit between the secondary metal rings of both UV phases. The metal ring of V phase and the metal ring of W phase are conductively connected through the upper and lower sides of the second rectangular tube 5*b* to create interphase short-circuit between the secondary metal rings of both phases VW. The metal ring of phase U and the metal ring of phase W are conductively connected through the shell case 4 to create interphase short-circuit between the secondary metal rings of both phases UW. As the above-mentioned metal rings are conductively connected through the same metal shell to create three-phase short-circuit in the secondary metal rings, the vector sum of the three-phase short-circuit comes to zero and the metal shell is at zero potential during operation.

All parts of the said heating device 20 but the opening of outgoing lines in the connector base are immersed in liquid; when its three-phase primary windings are connected with a three-phase industrial frequency power source, high current is induced in each secondary metal ring of the metal shell that surrounds the iron core 1 and the primary winding 2 of each phase along the closed three-phase magnetic loop; the secondary metal ring of each phase is conductively connected through the same metal shell so that high currents are generated from interphase and three-phase short-circuits; under the combined effects of the two high currents, the metal shell is heated rapidly and the heat is in turn conducted via the metal shell to its surrounding liquid; the vector sum of the three-phase short-circuit created by the secondary metal rings comes to zero so that the metal shell is at zero potential. This heating method with double high currents increases the output power of the whole unit effectively as compared with existing heating methods when the sectional area of iron core is identical.

The two views in FIG. 4 show a device 30 of fluid heating by electromagnetic induction and short-circuit using three-phase industrial frequency power according to the present invention. In the two rectangular tubes 5 of heating device 30, the first rectangular tube 5*a* and the second rectangular tube 5*b* with the semi-enclosed structure shown in FIG. 2-4 are used. Except the rectangular tubes 5 that are different from those used in heating device 20, the rest structures of heating device 30 are identical to those of heating device 20.

Example Application

Figure 5:
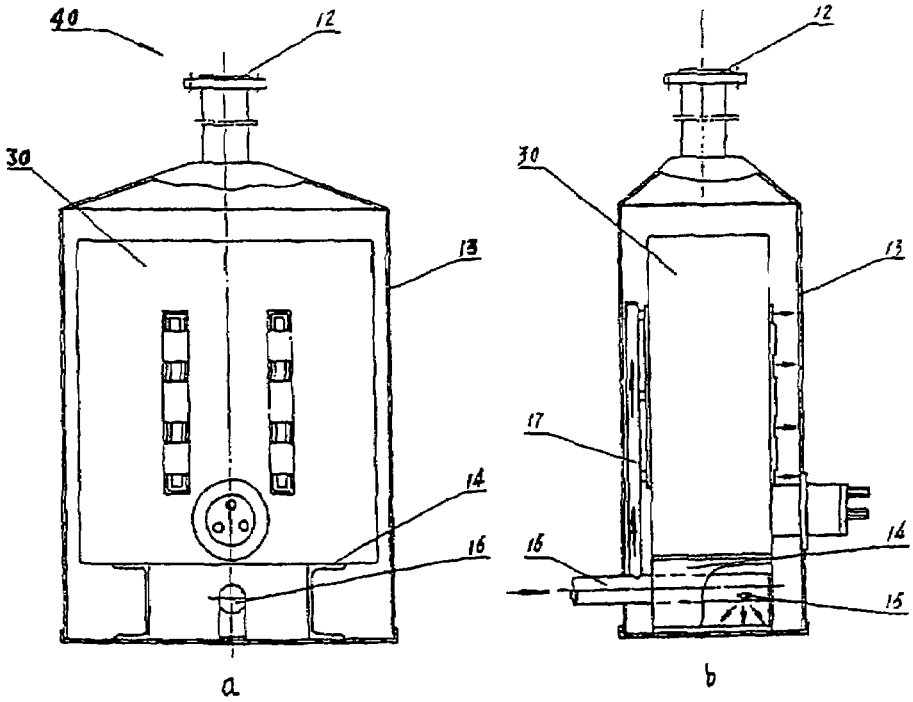
FIG. 5 is a schematic view of an application structure of the device of heating by electromagnetic induction and short-circuit using three-phase industrial frequency power according to the present invention, in which FIG. 5-*a* is a front view and FIG. 5-*b* is a lateral view of FIG. 5-*a*.

The front and lateral views in FIG. 5 show an assembled circulation-heating device 40 wherein the present invention is applied. A heating device 30 according to the present invention as described in above embodiment is used and fixed on the base frame 14 in the circulation container 13. The water to be heated in a water tank (not shown in the drawing) is pumped by a circulation pump through the inlet header pipe 16 into the circulation container 13, where the water is discharged through three flows: one flow goes through the round hole 15 to spray downwards and then go upwards after diffusion; the rest two flows go through branch pipes 17 (only one branch pipe shown in FIG. 5-*b*) by way of the six inlet round tubes 11 of this heating device 30 into the space between the two rectangular tubes 5 and the flow deflector 10 before they are discharged from the opposite ends of the two rectangular tubes 5. The above three water flows are delivered over the surface of the metal shell of this heating device 30 and the generated heat is carried by the heated water to go back through the outlet 12 into the water tank. By repeating the above process, the water in the water tank is heated to the required temperature.

Experiment Example 1

A comparison test was made between a heating device 30 of the embodiment according to the present invention and an eddy-current heating device with an identical power rating (315 kW/400V). Same quantity of water was heated from 16.5° C. to 95° C. in water temperature. The actual test values are recorded in Table 1. It is clear from the table that the present invention features a lower working current and a higher power factor up to 0.95. No additional compensating capacitor was required during operation; the temperature rise in the windings was 25.8° C. lower than that in the eddy-current heating device, which is beneficial to the service life of the heating device according to the present invention; the material consumption was significantly reduced and the manufacturing cost was lower.

TABLE 1

| Actual value | Current (A) | Power Factor (COS Φ) | Winding Temp. Rise (K.) | Material consumption (%) Iron | Copper |
|---|---|---|---|---|---|
| Heating device | | | | | |
| Eddy-current heating | 812 | 0.56 | 138.5 | 100 | 100 |
| Present invention | 478 | 0.95 | 112.7 | 67 | 49 |

The above test was conducted under identical circulation heating conditions. The difference was that a part of the circulating water in the heating device according to the present invention flowed through two rectangular tubes 5 and the rest part flowed over the surface of the metal shell, while the circulating water in the eddy-current heating device all flowed over the shell surface. Simply to say, the heat radiation around the primary winding 2 of each phase according to the present invention was adequate and uniform, while the heat radiation of the windings in the eddy-current heating device was inadequate in the areas between phases UV and phases VW. That was the reason why the winding temperature rise was 25.8 K higher by the measurement of resistance.

Experiment Example 2

In order to further demonstrate the working conditions of the metal shell when the heating device according to the present invention is supplied with power for operation, a destructive test was made on a heating device 30, which had a power rating of 630 kW, according to the present invention as described in above embodiment, in open air at 400V three-phase supply voltage. The actual test values are recorded in Table 2:

TABLE 2

| Actual value | Output Power (kW) | Power Factor (COS β) | Power Ratio (%) | Test Scope (Item) |
|---|---|---|---|---|
| Serial No. | | | | |
| 1 | 630.0 | 0.935 | 100 | Whole unit |
| 2 | 537.1 | 0.9220 | 85.26 | 4 metal rings in yoke area |
| 3 | 374.3 | 0.906 | 59.41 | Interphase short-citrcuit |
| 4 | 345.7 | 0.872 | 54.87 | Three metal rings of U, V, W |

Test 1 was conducted with the actual power, i.e. the rated power, at 630 kW under intact conditions before destruction. The heat power, generally known as copper loss and iron loss, of the primary windings and the iron core was 8.7 kW, accounting for 1.381% of the rated power.

By conducting Test 2, the top tray 3*a* and the bottom tray 3*b* on the metal shell were respectively separated from the shell case 4 so that the current loop in the four secondary metal rings around the upper and lower yokes was cut off. At this time, the structures of the three secondary metal rings of U, V, W as well as the interphase and three-phase short-circuits were not changed. The difference between the actual output power and the rated power was exactly the sum of output powers of the above four secondary metal rings.

Test 3 was conducted based on the above test to further separate the shell case 4 and the first rectangular tube 5*a* along the centerline between phases UV, i.e. the A-A section line in FIG. 4. The metal ring of phase U was made an independent secondary side and the metal rings of the rest two phases as well as their interphase short-circuits remained unchanged. But the three-phase short-circuit no longer existed. The difference between the actual output power and the output power measured in the following Test 4 was exactly the output power of interphase short-circuit of phases VW. Here, the total output power of interphase short-circuits was 3 times as much as that of phases VW when the rest two interphase short-circuits were identical with the former.

In Test 4, the shell case 4 and the second rectangular tube 5*b* were further separated with the above cutting method along the centerline between phases VW. The three metal rings of U, V, and W were made three independent secondary sides. The actual output power was exactly the sum of the output power of the three independent metal rings.

When the rated power was deducted by actual outputs known above, the difference 105.6 kW was exactly the output power of three-phase short-circuit, accounting for 16.76% of the rated power.

It can be seen from the heating device in Test 4 that the structure of the heating device was corresponding to that of the three-phase heating device described in European Patent EP0383272A2. Therefore, the output power should have been the same. But the actual output power measured in Test 4 was only 0.5487 times as much as the rated value. It is clear that the output power of the heating device according to the present invention is 1.8 times as much as that described in the European patent.

As for the copper and iron losses mentioned above, their percentage in the total power is small. But the primary windings in operation may rise in temperature very rapidly to exceed limit or even bum out under heat insulated conditions. Simply to say, the heat from the copper and iron losses should be conducted out through the metal shell. The more adequate the conduction, the lower is the temperature rise in the primary windings and the better is the reliability in the operation. For this reason, the temperature of the metal shell must be lower than that of the primary windings and a greater temperature difference will be more beneficial to conduction. However, the temperature distribution at different locations of the metal shell is not uniform. It is obvious in the above actual tests that the upper and lower sides of the first rectangular tube 5*a* and the second rectangular tube 5*b* had the highest temperature because of the concentration of heating by the interphase short-circuit current and the induction current from secondary metal rings. Therefore, a simple and effective method for heat radiation is to set up a flow deflector that is positioned in and connected with the rectangular tube or increase the flow in this section for uniform distribution of temperature over the whole metal shell.

INDUSTRIAL APPLICABILITY

The industrial application of the present invention includes: (1) In thermo technical design, a surface load parameter, which is defined as the heating (radiation) power per unit area, is involved. The larger the surface area, the greater is the reserve in the designed power. The present invention uses the metal shell that surrounds the iron core and the primary winding of each phase along the closed three-phase magnetic loop to constitute its main heating body, a maximized design reserve of power can be naturally obtained. (2) The metal shell according to the present invention is at zero potential during operation so that safety and reliability are ensured. (3) The rectangular tubes according to the present invention that allow for internal liquid flow are set respectively between the windings of phases UV and VW so that uniform heat radiation and lowered temperature rise around the three-phase primary windings can be achieved. This is beneficial to a longer service life. (4) The power factor is higher than 90% by applying the present invention. (5) At a same power rating, the sectional area of iron core is reduced by more than 30% and the material consumption of copper and iron is correspondingly reduced by more than 30% by applying the present invention as compared with those described in EP0383272A2 and ZL97106984.4. The manufacturing cost can be reduced significantly. Economic benefits that may be brought about by this invention are quite great in terms of batch production.

The invention claimed is:

1. A device of liquid heating by electromagnetic induction and shaft-circuit using three-phase industrial frequency power, comprising;

an El-formed core comprising multi-layered silicon steel sheets to form a closed three-phase magnetic loop, wherein each of three core legs of the El-formed core is coiled with a primary winding to form a three-phase primary winding, that can be connected by star or delta connection with the core and the three-phase primary windings being all enclosed in a metal shell, in which a space within the shell is packed with insulating fillers to form a completely-enclosed solid body, wherein the metal shell is set along the closed three-phase magnetic loop to form a secondary side of each phase that surrounds the core and the primary winding of each phase so as to constitute a main heating body of the device, and also acts as a protecting shell and a radiator for the core and the three-phase primary winding;

wherein when the secondary side of each phase is conductively connected through the same said metal shell to create an interphase short-circuit and a tree-phase short-circuit in the secondary side, a vector sum of the three-phase short-circuit comes to zero and the metal shell is at zero potential;

wherein said metal shell is provided with a top tray and a bottom tray, a shell case, rectangular tubes and a connector base; the connector base being welded to one side of the shell case and leading wires of the three-phase primary windings being led from the connector base; wherein the top tray and the bottom tray are welded to top and bottom ends of the shell case respectively;

of the rectangular tubes, a first rectangular tube is positioned between two phases of the three-phase primary windings and between upper and lower yokes of a corresponding said core, while a second rectangular tube is positioned between two phases of the three-phase primary windings and between the upper and lower yokes of the corresponding core;

the first and second rectangular tubes passing through front and rear sides of the shell case while four sides of the front and rear ends of the rectangular tubes are respectively welded to front and rear surfaces of the shell case;

wherein left and right sides of the rectangular tubes together with the shell case create separately three metal rings as secondary sides to surround the primary winding of each phase, while upper sides of the rectangular tubes together with the shell case and the top tray create separately four metal rings as secondary sides to surround the upper yoke and the lower sides of the first and second rectangular tubes together with the shell case and the bottom tray create separately two metal rings as secondary sides to surround the lower yoke; and wherein the metal rings acting as secondary sides make use of an effective length of the three-phase magnetic loop of the core so that an output power of the device is maximized.

2. The device of liquid heating by electromagnetic induction and short-circuit using three-phase industrial frequency power as claimed in claim 1, wherein front and rear ends of the rectangular tubes are open.

3. The device of liquid heating by electromagnetic induction and short-circuit using three-phase industrial frequency power as claimed in claim 2, wherein the upper and lower sides of the rectangular tubes are provided with introflexed wings.

4. The device of liquid heating by electromagnetic induction and short-circuit using three-phase industrial frequency power as claimed in claim 1, wherein the rectangular tubes are semi-enclosed at front and rear ends with at least one liquid inlet on one said end and at least three liquid outlets on the other end; the rectangular tubes having inner cavities with flow deflectors disposed therein, the flow detectors configured to radiate heat and accelerate flow speed.

* * * * *